US005454733A

United States Patent [19]

Watanabe et al.

[11] Patent Number: 5,454,733

[45] Date of Patent: Oct. 3, 1995

[54] DIVISIONAL MULTI-POLE CONNECTOR

[75] Inventors: Tamio Watanabe; Toru Nagano; Masayuki Yamamoto; Takashi Ishii, all of Shizuoka, Japan

[73] Assignee: Yazaki Corporation, Tokyo, Japan

[21] Appl. No.: 230,777

[22] Filed: Apr. 21, 1994

[30] Foreign Application Priority Data

Apr. 21, 1993 [JP] Japan ..... 5-116651

[51] Int. Cl.[6] ..... H01R 13/518

[52] U.S. Cl. ..... 439/540.1

[58] Field of Search ..... 439/701, 540, 439/638, 639, 640, 364

[56] References Cited

U.S. PATENT DOCUMENTS

| | | | |
|---|---|---|---|
| 4,764,130 | 8/1988 | DiClemente | 439/701 |
| 4,915,641 | 4/1990 | Miskin et al. | 439/701 |
| 4,923,411 | 5/1990 | Hayashi et al. | 439/638 |
| 5,007,858 | 4/1991 | Daly et al. | 439/364 |
| 5,312,268 | 5/1994 | Sumida | 439/596 |

FOREIGN PATENT DOCUMENTS

| | | | |
|---|---|---|---|
| 60-132126 | 7/1985 | Japan . | |
| 2274559 | 7/1994 | United Kingdom | 439/540 |

*Primary Examiner*—Gary F. Paumen

*Attorney, Agent, or Firm*—Sughrue, Mion, Zinn, Macpeak & Seas

[57] ABSTRACT

The present divisional multi-polar connector is free from difficulties caused by uneven end portions of the male connector housings, such as deformation of the connector, entanglement of the wire harness or the like with the connector during transportation, or damage to the terminals. In a divisional multi-polar connector in which plural kinds of male connector housings are protruded from a first frame, the front end of the first frame has recesses so that the engaging surfaces of the end portions of the male connector housings are made flush with each other. When a male connector housing is not present, a dummy housing is provided, so that all the points on the overall engaging surface of the connector are co-planar.

7 Claims, 4 Drawing Sheets

DIVISIONAL MULTI-POLE CONNECTOR

BACKGROUND OF THE INVENTION

Field of the Invention

This invention relates to a divisional multi-pole connector comprising plural kinds of connectors mounted on a single frame.

Description of the Prior Art

A wire harness connected to various lamps, wipers, a fuel meter, a speed meter, etc. on a motor vehicle are connected to a junction box including the sockets thereof, thus forming data signal transmitting paths to relays, circuit breakers, fuses, and control units coupled to the junction box. A junction box of this type has been disclosed by, for instance, Japanese Patent Application (OPI) No. 132126/1985 (the term "OPI" as used herein means an "unexamined application"). The junction box thus disclosed is as shown in FIG. 6; that is, the junction box 50 comprises: a sub socket 51 which is connected to a relay; a sub socket 52 which is engaged with a circuit breaker; a sub socket 53 to which fuses are connected; a sub socket 54 which is connected to a control unit. Furthermore, the junction box 50 is so designed that the blocks of the wire harness which have female terminals in correspondence to the sub sockets 51 through 54 are mounted on the rear surface of the junction box 50.

Of those female terminals of the junction box 50, for instance, female terminals 55 for connecting the relay, as shown in FIG. 7, are inserted into insertion holes 56 formed in the sub socket 51 and locked there, and are engaged with the male terminals of the relay inserted into the sub socket from above. The remaining sub sockets are different in size in correspondence to the configurations of the male terminals of the circuit breaker, the fuses, and the control unit, respectively, and have steps in the engaging surface where they are engaged with connecting units or mating connectors mounted on the junction box.

On the other hand, FIG. 8 shows a divisional multi-pole connector comprising plural kinds of connector housings different in configuration which are arranged on a single frame so as to connect a plurality of wire harnesses at one position. In the connector, frame 58 has a bolt 57 at the center which is engaged with a bolt hole of a mating frame (not shown), four guide ribs 59, respectively, at the four corners which are engaged with the mating frame. The frame 58 further includes cavities 61 around the aforementioned bolt 57, in which the connector housings 60 are set. With the guide ribs 59 engaged with guide holes of the mating frame, the bolt is tightened so that the two frames are fastened to each other, whereby the connector housings on one of the two frames are connected to those on the other.

The divisional multi-pole connector has a common structure so that the frame can be applied to any place in the motor vehicle. For instance, in the case where the number of connectors is small depending on the kind of the motor vehicle, the two frames are fastened to each other with some of the cavities (provided for connector housings) left open.

When the various connector housings are retained in the frame the engaging surfaces of the connector housings are staggered. Therefore, when an electronic unit is engaged with or disengaged from the connector, it may be caught by the adjacent unit or units, or it may be damaged because of the poor working condition due to the steps. On the other hand, in the case where the divisional multi-pole connector have some of its cavities which are not engaged with connector housings, the guide ribs are protruded from the engaging surface of the connector, thus substantially forming steps in the engaging surface. Therefore, the guide ribs may strike against the connectors mounted on the mating frame, to damage, for instance, the terminals thereof. In addition, during engagement of the connector, the insertion is advanced on the side of the cavity. Therefore, on the connector mounting side, the insertion is delayed by the action of the force of engagement, so that the frames may be cocked with respect to each other, and the terminals may be deformed.

In the case where the end surface of the end portion of the connector housing is uneven, or the connector housing has recesses which are formed by omitting parts of the connector housing, the wire harness may be damaged dropping in the recesses or being caught by the uneven engaging surface.

In view of the foregoing, an object of this invention is to provide a divisional multi-pole connector in which the mating connectors are smoothly engaged with each other, and which is prevented from being deformed, and which is free from the difficulty that it catches or entangles a wire harness or the like, to damage the terminals thereof.

SUMMARY OF THE INVENTION

The foregoing object of the invention has been achieved by the provision of a divisional multi-pole connector in which plural kinds of male connector housings are provided in a first frame in such a manner that the male connector housings are protruded from the first frame, and plural kinds of female connector housings corresponding to the male connector housings are provided in a second frame; in which, according to the invention, the male connector housings are arranged in the frame in such a manner that the engaging surfaces of the end portions thereof are co-planar, i.e., flush with one another.

In order to make the engaging surfaces of the male connector housings flush with one another, either (1) the frame supporting the male connector housings has surface which are staggered in correspondence to the lengths of the male connector housings, or (2) the surrounding wall of the male connector housing is extended, or (3) in a block of the frame where no male connector housing is provided, a dummy housing is provided.

In any one of the above-described methods (1) through (3), the engaging surfaces are made co-planar or flush with one another. Hence, the divisional multi-pole connector of the invention is free from the difficulty that during engagement, the frames are tightened shifted from each other, so that the connector is deformed. Thus, the connector is prevented from being damaged.

BRIEF DESCRIPTION OF THE DRAWINGS

Preferred embodiments of this invention will be described with reference to the accompanying drawings.

BRIEF DESCRIPTION OF THE DRAWINGS

Figure 1:
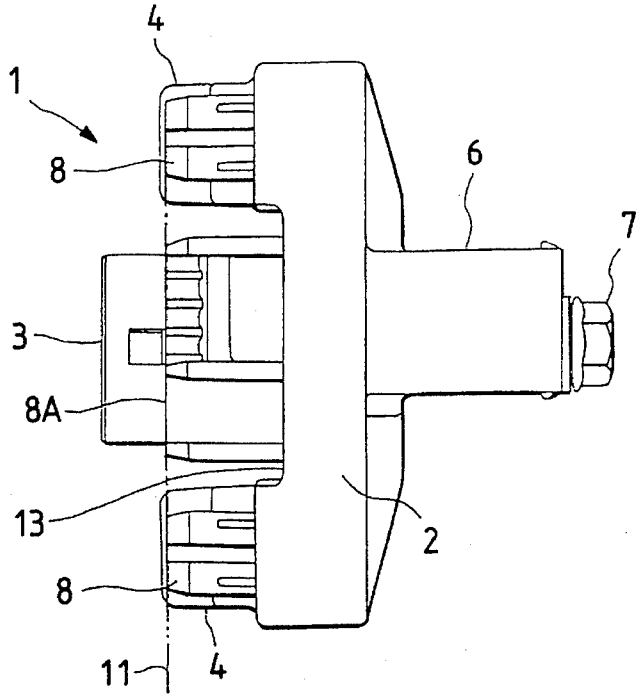

FIG. 1 is a side view of an example of a divisional multi-pole connector, according to a first embodiment of this invention.

Figure 2:
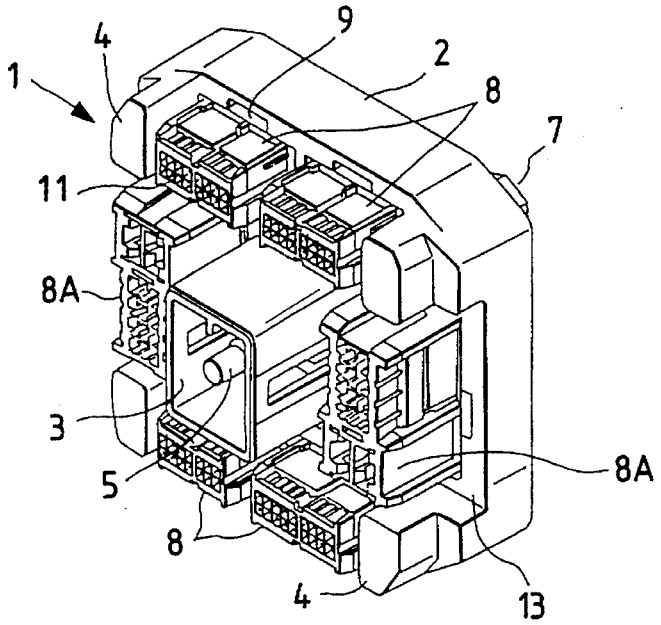
Figure 3:
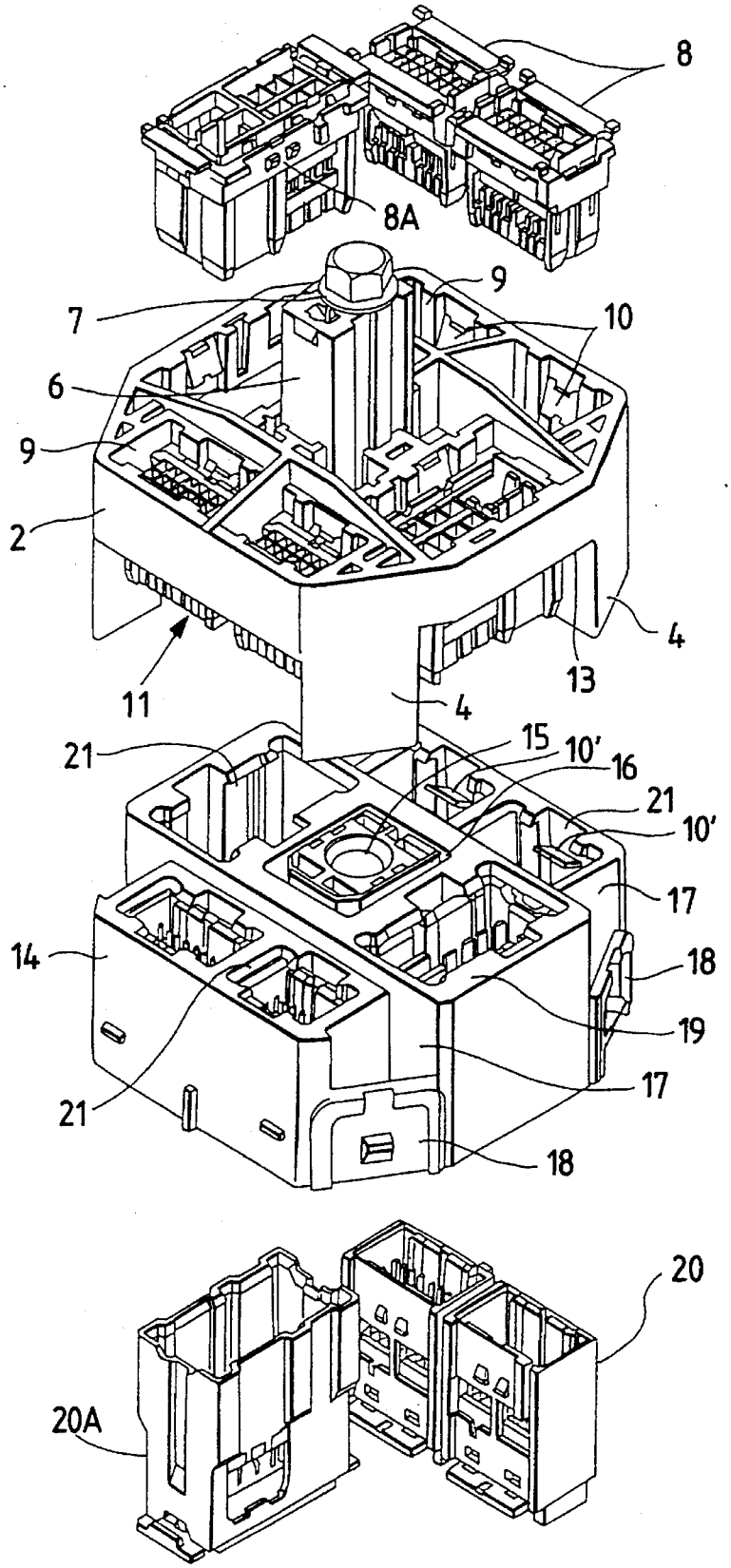
Figure 4:
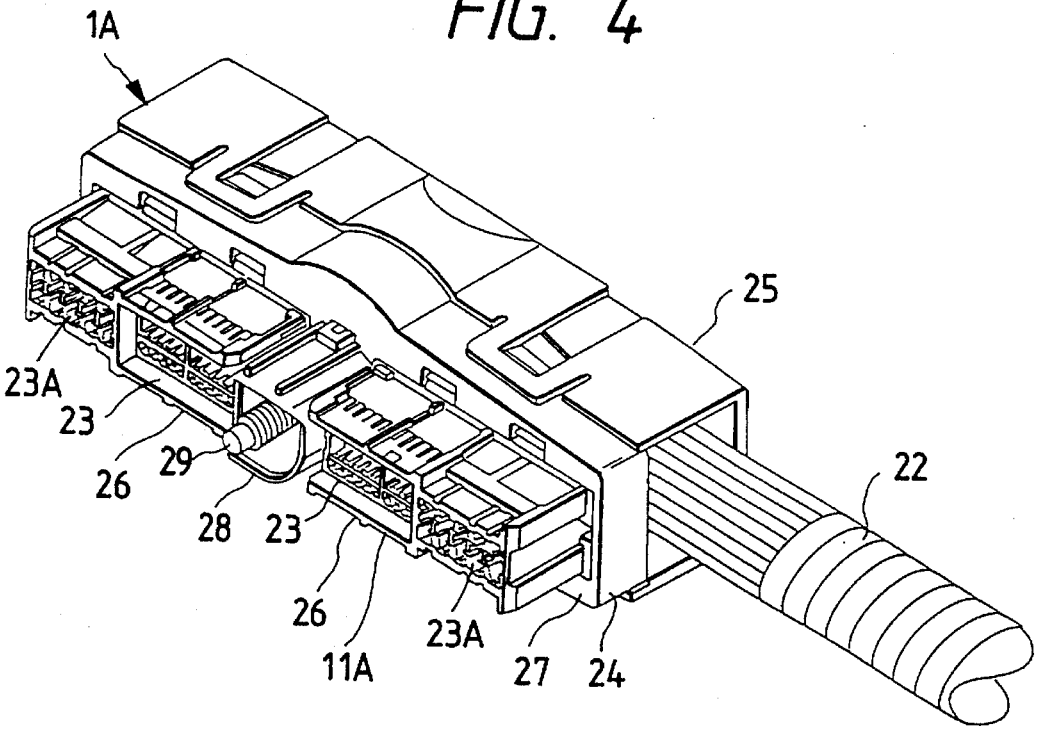
Figure 5:
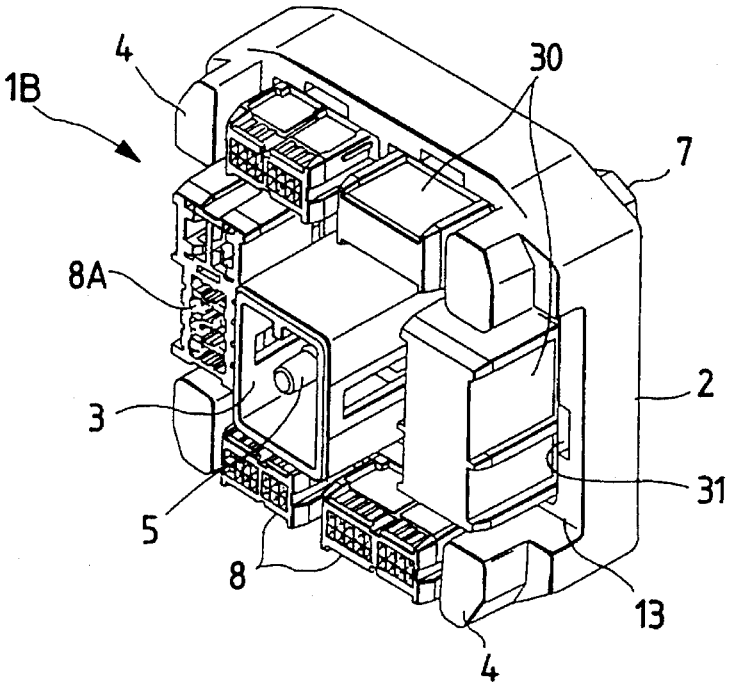
Figure 6:
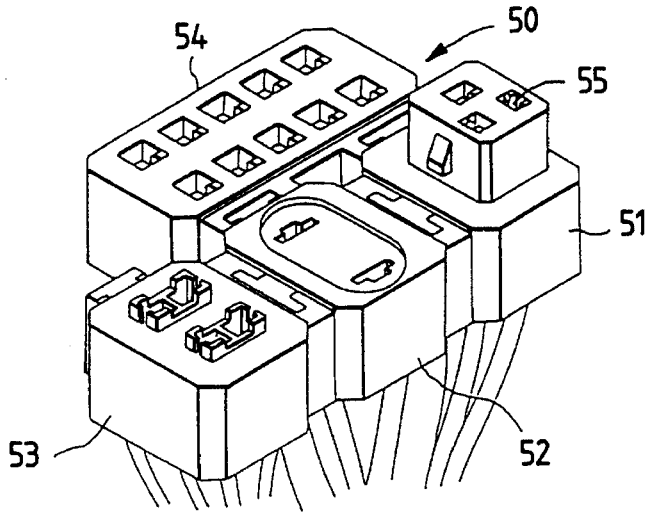
FIG. 6 PRIOR ART
Figure 7:
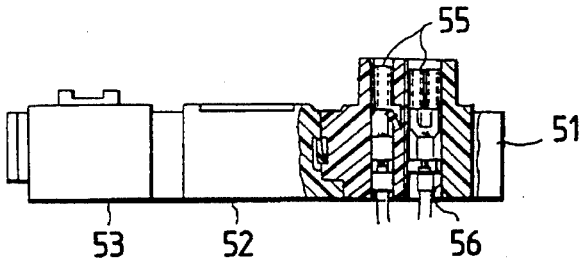
FIG. 7 PRIOR ART
Figure 8:
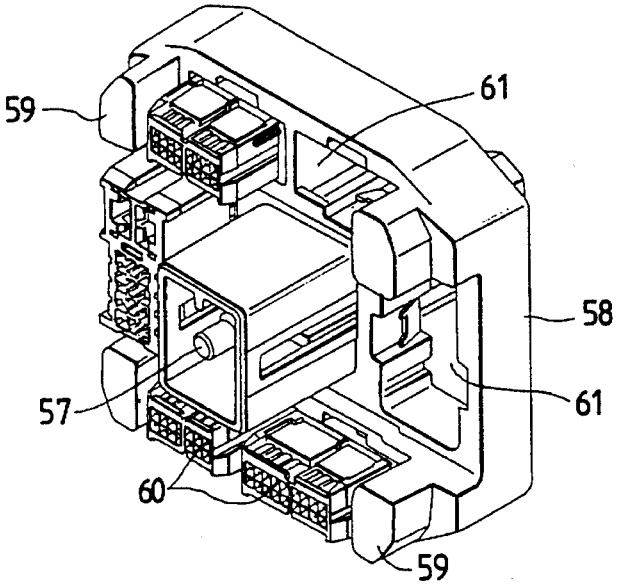
FIG. 8 PRIOR ART

FIG. 2 is a perspective view of the divisional multi-pole connector shown in FIG. 1;

FIG. 3 is an exploded perspective view showing a first frame and a second frame in the divisional multi-pole connector shown in FIG. 1;

FIG. 4 is a perspective view of another example of the divisional multi-pole connector, according to a second embodiment of the invention;

FIG. 5 is a perspective view of another example of the divisional multi-pole connector, according to a third embodiment of the invention, showing dummy housings coupled thereto;

FIG. 6 is a perspective view showing an example of a conventional divisional multi-pole connector;

FIG. 7 is a side view, with parts cut away, of the conventional divisional multi-pole connector shown in FIG. 6; and FIG. 8 is a perspective view showing another example of the conventional divisional multi-pole connector.

DETAILED DESCRIPTION OF THE PREFERRED EMBODIMENTS

FIGS. 1 through 3 show an example of a divisional multi-pole connector according to a first embodiment of the invention. More specifically, FIGS. 1 and 2 are a side view and a perspective view, respectively, showing the divisional multi-pole connector. FIG. 3 is an exploded perspective view of the divisional multi-pole connector.

As shown in FIGS. 1 through 3, the divisional multi-pole connector 1 comprises: a substantially box-shaped first frame 2; a quadrangular cylinder 3 protruded from the center of the front end face of the first frame 2; and four guide protrusions 4, which are each substantially in the form of a quadrangular prism, at four corners of the front end face of the first frame 2. The first frame 2 has recesses 13 on the front side. A bolt 5 is provided along the central axis of the quadrangular cylinder 3, and its rear end is mounted on a support 6 which is protruded from the rear end face of the first frame 2, in such a manner that, as a bolt head 7 on the support 6 is turned, the bolt 5 is turned to engage with or disengage from a nut (not shown) provided on the mating second frame.

The first frame 2 has mounting holes 9, outside the quadrangular cylinder 3 and the guide protrusions 4, in which plural kinds of male connector housings 8 and 8A of multi-pole structure type are mounted. The mounting holes 9 are through-holes which are shaped in correspondence to the connector housings, and extended from the front surface to the rear surface of the first frame 2. Locking parts 10 are formed in the through-holes at predetermined positions, to lock the male connector housings 8 and 8A therein. By positioning the locking parts 10 according to the lengths of the contact parts of the male connector housings 8 and 8A, i.e., according to the dimensions of the small connector housings 8 and the large connector housings 8A, and by determining the shape of the steps formed by the recesses 13 according to the dimensions of the connectors protruded from the first frame 2, the engaging surface of the front end portions of the male connector housings 8 and 8A mounted in the first frame 2 are made flush with each other. In other words, in order to make the engaging surfaces 11 flush with each other (engaging surfaces 11 being the front end faces of the male connector housings 8 and 8A which are different in dimension), the recesses 13 are formed in the first frame 2 on the front side, and the locking parts 10 are arranged at different positions in the direction of insertion of the connectors, i.e., the depth direction.

The second frame 14 engaged with the first frame 2 is substantially square, being similar to the first frame 2. The second frame 14, as shown in FIG. 3, has a nut hole 15 at its center which is engaged with the aforementioned bolt 5, and a quadrangular groove 16 around the nut hole 15 which is engaged with the aforementioned quadrangular cylinder 3. The second frame 14 further comprises four guide holes 17 at four corners which are engaged with the guide protrusions 4. As the first frame 2 is pushed against the second frame 14, the quadrangular cylinder 3 of the first frame 2 is engaged with the quadrangular groove 16 of the second frame 14, while the guide protrusions 4 of the first frame 2 are engaged with the guide holes 17 of the second frame 14, and completely locked with locking members 18 provided below the guide holes 17. Under this condition, the bolt 7 of the first frame 2 is turned to fasten the first frame 2 to the second frame 14.

The second frame 14 has protrusions 19 in the engaging surface through which it is engaged with the first frame 2. The protrusions 19 are so shaped that they are opposite in configuration to the recesses 13 of the first frame 2. That is, when the second frame is engaged with the first frame, the former is brought into close contact with the latter. The second frame 4 has a plurality of mounting holes 21, which are through-holes extended from the front end face of the second frame 14 to the rear end face. In the mounting holes 21, female connector housings 20 and 20A corresponding to the male connector housings 8 and 8A mounted in the first frame 2 are provided. More specifically, the female connector housings 20 and 20A are inserted into the mounting holes 21 from the rear side of the second frame 14, and fixed therein. In the mounting holes 21, locking parts 10' are provided to secure the female connector housings 20 and 20A at predetermined positions. With the aid of the locking parts, the female connector housings 20 and 20A are held in the second frame 14 in such a manner that their end faces are flush with the surfaces of the protrusions 19. When the engaging surfaces 11 of the male connector housings 8 and 8A of the first frame 2 are inserted until they come to the engaging ends of the male connector housings 20 and 20A, the first and second frames 2 and 14 are brought into close contact with each other, and the terminals of the first frame are electrically connected to those of the second frame.

The first frame 2 and the second frame 14 can be readily disengaged from each other by turning the bolt head 7 of the first frame 2 in the opposite direction.

FIG. 4 shows another example of the divisional multi-pole connector according to a second embodiment of the invention.

The divisional multi-pole connector 1A is formed as follows: Differently sized male connectors housings 23 and 23A, to which a wire harness 22 is connected, are mounted in a first frame 24 from behind similarly as in the case of the first embodiment. The first frame 24 is substantially in the form of a rectangular prism and has a flat front end 27. Under this condition, the wire harness 22 is bent at right angles, and a frame cover 25 is engaged with the first frame 24 from behind. In this case, it is difficult to make the engaging surfaces 11A of the male connector housings 23 and 23A flush with each other because of the structure. Therefore, the smaller of the male connector housings 23 and 23A (the male connector housing 23 in this example) is so designed that its surrounding wall 26 is extended until it becomes flush with the end face of the other male connector housing 23A, so that their engaging surfaces 11A are substantially flush with each other. The divisional multi-pole connector has a cylindrical protrusion 28 at the middle, or between the male connector housings 23 and 23A on the right side and those 23 and 23A on the left side, and a fastening bolt 29 is provided inside the cylindrical protrusion 28.

A second frame (not shown) has a groove to be engaged with the cylindrical protrusion 28, and female connector housings for receiving the male connector housings 23 and 23A. When the connector housings of the first frame are engaged with those of the second frame, the confronted end faces of those frames are abutted against each other, so that the two frames are brought into close contact with each other.

The male connector housings 23 and 23A have a surrounding wall 26 which substantially makes the engaging surfaces 11A flush with each other; that is, the connector housings have no protrusions in the end faces, which eliminates the difficulty that the connector is damaged during engagement or disengagement or during transportation.

FIG. 5 shows another example of the divisional multi-pole connector according to a third embodiment of the invention.

The divisional multi-pole connector 1B shown in FIG. 5 is similar in construction to the one shown in FIGS. 1 through 3, the first embodiment. However, the third embodiment is different from the first embodiment in the following point: Of the mounting holes 9 (cf. FIG. 3) which are engaged with the male connector housings 8 and 8A, those 31 with which no connector housings are engaged depending on the use of the connector, are engaged with dummy housings 30 in such a manner that the engaging surfaces of the latter 30 are flush with those of the male connector housings 8 and 8A.

The dummy housings 30 are so designed that they are hollows, and the upper surface of each of the dummy housings 30, which comes outside, is a flat surface which is flush with the engaging surfaces. By engaging the dummy housings 30 with the vacant mounting holes 31, the connector has no recesses which are due to the cavities 61 (cf. FIG. 8). That is, the engaging surfaces are flush with one another. The function of the divisional multi-pole connector 1B is equal to that of the first embodiment shown in FIGS. 1 through 3.

In any one of the above-described divisional multi-pole connectors 1A and 1B, the engaging surfaces are flush with one another. Hence, those connectors are free from the difficulties that they are deformed during engagement or disengagement, and the wire harness entangles them during transportation; that is, they are prevented from damage when handled.

As described above, in the divisional multi-pole connectors, in order to make the engaging surfaces of the front end portions of different kinds of male or female connector housings flush with one another, the supporting front surfaces of the frame are staggered in the longitudinal direction or the dummy housings are received in the cavities. Hence, the divisional multi-pole connector of the invention is completely free from the difficulty that it catches the wire harness or it deforms the mating connector, to damage, for instance, the terminals.

What is claimed is:

1. A divisional multi-pole connector, comprising:

a first frame, in which plural kinds of male connector housings are provided extending in a longitudinal direction of said first frame so that said male connector housings protrude from said first frame, said male connector housings having different lengths in said longitudinal direction; and a second frame, in which plural kinds of female connector housings corresponding to said male connector housings are provided, said first and second frames being engageable, wherein said plural kinds of male connector housings are arranged in said first frame in such a manner that engaging front surfaces of end portions thereof are co-planar.

2. A divisional multi-pole connector as claimed in claim 1, wherein said male connector housings respectively abut against supporting front surfaces of said first frame which are staggered in said longitudinal direction.

3. A divisional multi-pole connector as claimed in claim 1, wherein each of said plural kinds of male connector housings has a surrounding wall of a predetermined length thereby making said engaging surfaces co-planar.

4. A divisional multi-pole connector as claimed in claim 1, wherein in a cavity of said first frame where no male connector housing is provided, a dummy housing is provided to make said engaging surfaces co-planar.

5. A divisional multi-pole connector as claimed in claim 2, wherein in a cavity of said first frame where no male connector housing is provided, a dummy housing is provided to make said engaging surfaces co-planar.

6. A divisional multi-pole connector as claimed in claim 3, wherein in a cavity of said first frame where no male connector housing is provided, a dummy housing is provided to make said engaging surfaces co-planar.

7. A divisional multi-pole connector, comprising:

a first frame having a plurality of cavities for respectively receiving plural kinds of one of (1) male connector housings and (2) female connector housings, the housings having different lengths and including means for receiving and retaining respective said connector housings such that engaging front surfaces thereof are co-planar; and a second frame having plural kinds of another one of said male and female connector housings retained therein which are respectively engageable with said one connector housings.

* * * * *